US012791020B2

(12) United States Patent
Gernentz et al.

(10) Patent No.: US 12,791,020 B2
(45) Date of Patent: Nov. 10, 2026

(54) PLUNGER LIFT WITH AN ADJUSTABLE AND VARIABLE CLUTCH

(71) Applicant: Endurance Lift Solutions, LLC, Gainesville, TX (US)

(72) Inventors: Ryan Gernentz, Midland, TX (US); Travis Bayer, Conroe, TX (US); Benjamin Garcia, Cypress, TX (US)

(73) Assignee: Endurance Lift Solutions, LLC, Gainesville, TX (US)

( * ) Notice: Subject to any disclaimer, the term of this patent is extended or adjusted under 35 U.S.C. 154(b) by 0 days.

(21) Appl. No.: 19/334,421

(22) Filed: Sep. 19, 2025

(65) Prior Publication Data

US 2026/0022694 A1 Jan. 22, 2026

Related U.S. Application Data

(63) Continuation of application No. 18/654,706, filed on May 3, 2024, now Pat. No. 12,442,368.

(51) Int. Cl.

| | |
|---|---|
| ***F04B 47/12*** | (2006.01) |
| ***E21B 43/12*** | (2006.01) |
| ***F04B 53/00*** | (2006.01) |

(52) U.S. Cl.

CPC ..... *F04B 47/12* (2013.01); *E21B 43/121* (2013.01); *F04B 53/00* (2013.01)

(58) Field of Classification Search

CPC .... E21B 43/121; E21B 43/122; E21B 43/123; F04B 47/12; F04B 47/00; F04B 53/00

See application file for complete search history.

(56) References Cited

U.S. PATENT DOCUMENTS

| | | | | |
|---|---|---|---|---|
| 7,383,878 | B1 * | 6/2008 | Victor | E21B 43/121 166/105 |
| 2015/0000761 | A1 * | 1/2015 | Jefferies | E21B 34/08 137/554 |
| 2016/0326841 | A1 * | 11/2016 | Farrow | E21B 37/10 |
| 2017/0107802 | A1 * | 4/2017 | Kuykendall | E21B 43/121 |
| 2022/0145736 | A1 * | 5/2022 | Boyd | E21B 43/121 |
| 2023/0029090 | A1 * | 1/2023 | Roycroft | E21B 43/121 |

* cited by examiner

*Primary Examiner* — George S Gray

(74) *Attorney, Agent, or Firm* — Hall Estill Law Firm

(57) ABSTRACT

A plunger including a plunger body having a radially directed flow hole disposed therein; a pin that is removable without destroying the pin or the plunger body; a clutch mechanism supported by the pin to control the force necessary to shift the pin in the plunger body; and a bumper portion supported by a body of the pin to limit the travel of the pin in the plunger body during operational use of the plunger. A method of lifting oil and gas fluids by inserting the plunger in a well wherein the pin is removable from the plunger body without destroying the pin or the plunger body; removing a pin from a plunger body without destroying the pin or the plunger body; and/or repairing or adjusting a part of the pin and reinstalling the repaired or adjusted pin in the plunger body.

19 Claims, 7 Drawing Sheets

PLUNGER LIFT WITH AN ADJUSTABLE AND VARIABLE CLUTCH

CROSS-REFERENCE TO RELATED APPLICATIONS

The present application is a continuation application of U.S. patent application Ser. No. 18/654,706, filed May 3, 2024, which is a conversion of U.S. Provisional Application having U.S. Ser. No. 63/463,792, filed May 3, 2023, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a plunger with a pin that has an adjustable and repairable clutch that can be removed from the plunger body wherein the clutch can adjusted and repaired to maximize the life of the plunger. Other components of the pin can be repaired or replaced as well.

2. Description of the Related Art

Typically, clutch mechanisms and pins of plunger lifts are the first components of a plunger lift to fail. Additionally, the body portion of a single piece body plunger is the most expensive part of plunger lifts and the plunger body has to be destroyed to get to the pin and/or clutch mechanism. Thus, when the clutch mechanisms of current designs fail, a lot of times the entire plunger has to be discarded, which is very inefficient.

Accordingly, there is a need for a plunger with a removable pin that has a clutch that is adjustable and repairable to maximize the life of plungers.

SUMMARY OF THE DISCLOSURE

The present disclosure is directed to a plunger. The plunger includes a plunger body having a radially directed flow hole disposed therein and a pin that is removable from the plunger body without destroying the pin or the plunger body, the pin shifts back and forth in the plunger body to block the flow hole in a first position and allow fluid to flow through the flow hole in a second position. The plunger also includes a clutch mechanism supported by the pin to control the force necessary to shift the pin in the plunger body and a bumper portion supported by a body of the pin to limit the travel of the pin in the plunger body during operational use of the plunger.

The present disclosure is also directed to a method of lifting oil and gas fluids from a well using the plunger. The method includes the step of inserting the plunger into a well, the plunger including a plunger body having a pin disposed at least partially therein that is removable from the plunger body without destroying the pin or the plunger body.

The present disclosure is also directed to another method. The method includes the step of removing a pin from a plunger body without destroying the pin or the plunger body.

The method also includes the step of repairing or adjusting a part of the pin and reinstalling the repaired or adjusted pin in the plunger body.

DETAILED DESCRIPTION OF THE DISCLOSURE

Figure 1A:
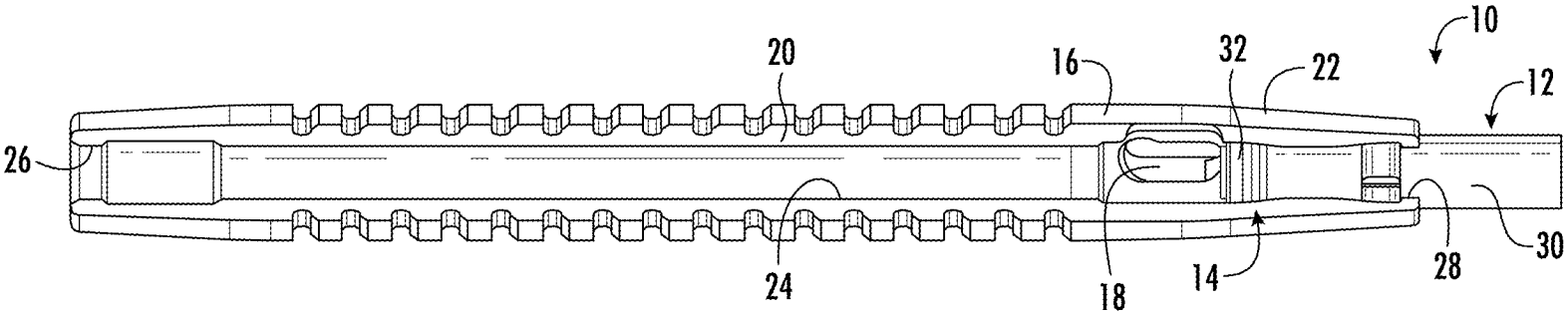
FIG. 1A is a side elevation view of a plunger with a partial cut out section constructed in accordance with the present disclosure.
Figure 1B:
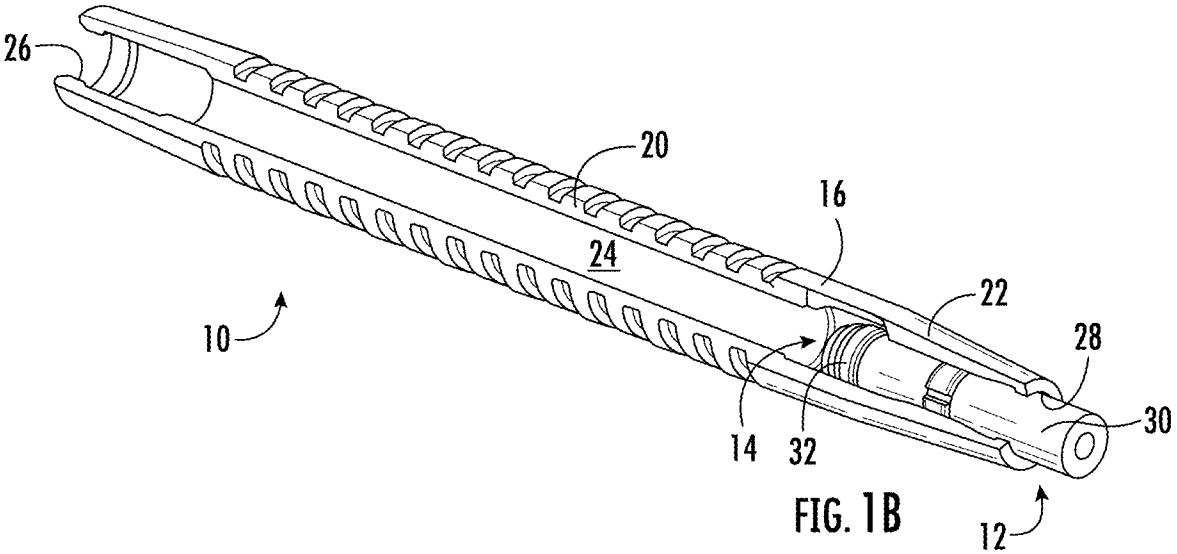
FIG. 1B is a perspective view of the plunger with a partial cut out section constructed in accordance with the present disclosure.
Figure 2A:
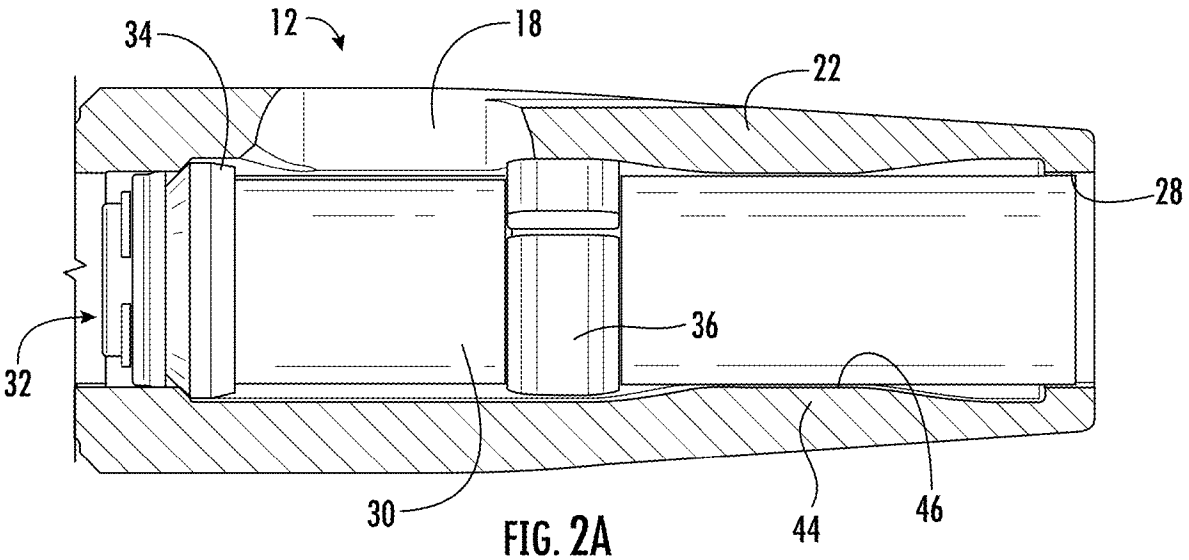
FIG. 2A is a close-up view of a part of the plunger shown in FIG. 1A in a first position constructed in accordance with the present disclosure.
Figure 2B:
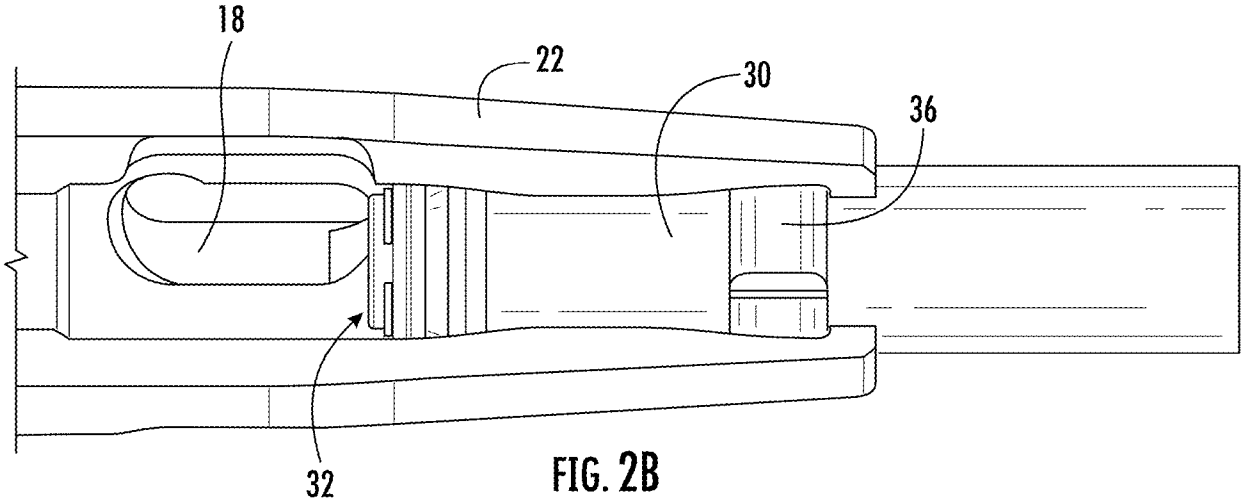
FIG. 2B is a close-up view of the part of the plunger shown in FIG. 2A in a second position constructed in accordance with the present disclosure.
Figure 3A:
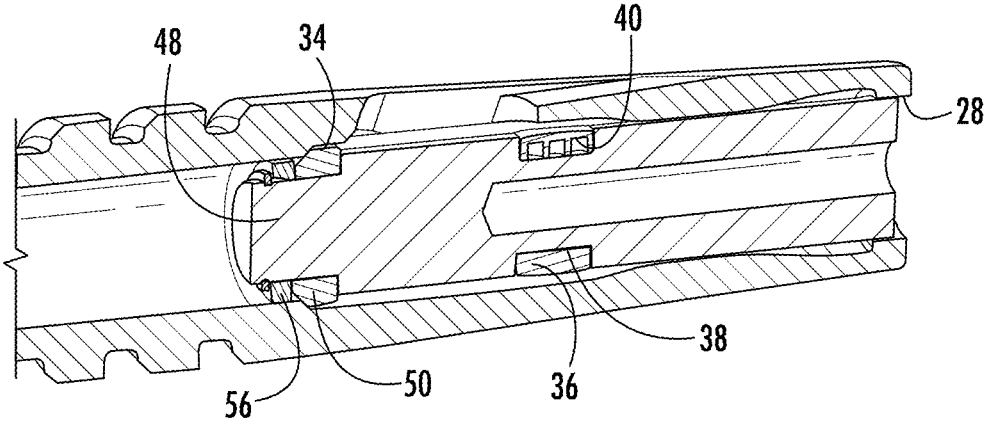
FIGS. 3A-3C show various other views of the part of the plunger shown in FIGS. 2A and 2B constructed in accordance with the present disclosure.
Figure 3B:
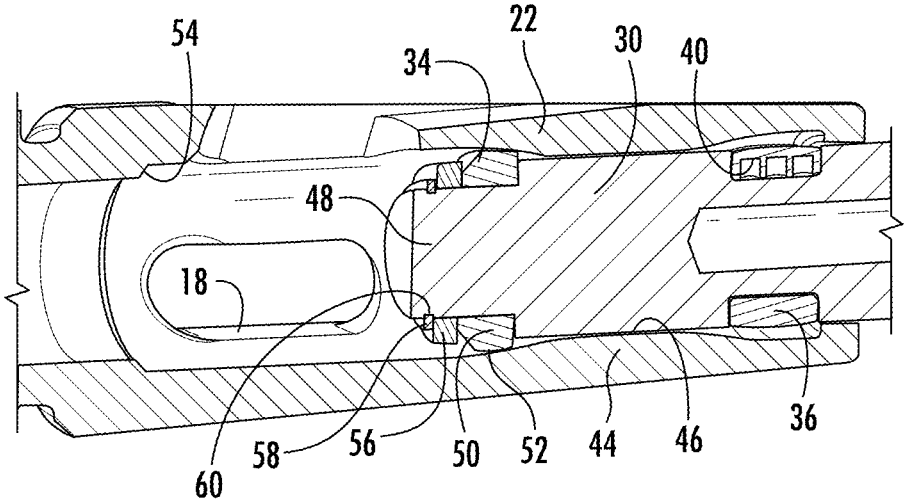
Figure 3C:
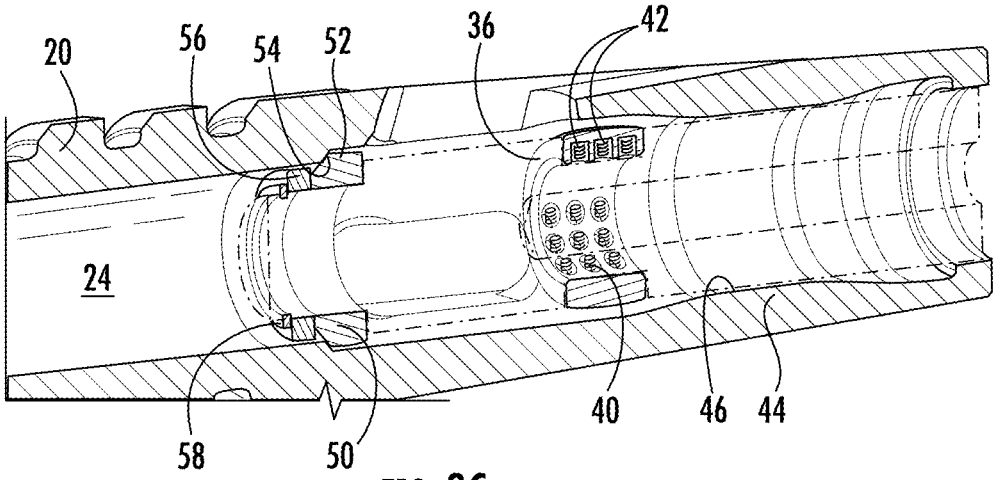

Referring now to FIGS. 1A and 1B, the present disclosure relates to a plunger 10 with a removable pin 12 having a clutch 14 that can be adjusted and repaired. The pin 12 can be removed from a plunger body 16 of the plunger 10, the clutch can be repaired and reinstalled in the plunger body 16 of the plunger 10. Various parts of the pin 12 can be repaired and replaced after the pin 12 is removed from the plunger body 16. The clutch load can also be adjusted to achieve the desired shifting ability of the pin 12 in the plunger 10. The pin 12 can be inserted in the plunger body 16 and certain components of the pin 12 can be mounted to the pin 12 while the pin 12 is in the plunger body 16. Once these components are mounted, the pin 12 slides in the plunger body 16 to open and close a flow hole 18 disposed in the plunger body 16 but cannot slide out of the plunger body 16.

The plunger body 16 of the plunger 10 can be constructed of a single piece (i.e., not parts threaded together). The plunger body 16 also includes a mandrel portion 20 and a flow portion 22 where the pin 12 can slide back and forth between a first position and a second position inside the flow portion 22. A passageway 24 can extend axially through the plunger body 16 between a mandrel opening 26 disposed on in the mandrel portion 20 of the plunger body 16 and a pin opening 28 disposed in the flow portion 22 of the plunger body 16. The flow portion 22 includes the flow hole 18 to allow fluid to flow through the plunger body 16 via the mandrel opening 26, the passageway 24 in the mandrel portion 20 and the flow hole 18 when the pin 12 is in the open position. Conversely, when the pin 12 is in a closed position, the pin 12 is positioned uphole in the flow portion 22 of the plunger 10 as possible so fluid cannot flow through the plunger body 16 of the plunger 10. When the pin 12 is in the open position, the pin 12 is shifted downhole in the flow portion 22 of the plunger body 16 as much as possible such that part of the pin 12 extends out of the pin opening 28 in the flow portion 22 of the plunger body 16. When the plunger 10 is in this orientation, the plunger 10 is permitted to fall in the well until the plunger 10 contacts something that forces the pin 12 into the closed position. Thus, when the pin 12 is in the open position, the passageway 24 through the mandrel portion 20 of the plunger 10 is in fluid communication with the flow hole 18 in the flow portion 22 of the plunger body 16. The plunger 10 could contact a bottom hole bumper spring, a standing valve or a bottom hole assembly to cause the pin 12 to slide back into the closed position. The flow hole 18 in the flow portion 22 of the plunger body 16 can be ultimately radially directed in the side of the plunger body 16.

The pin 12 includes a body 30, a clutch mechanism 32 supported by the body 30 to control the force needed to shift the pin 12 between the open and closed positions, and a bumper portion 34 supported by the body 30 of the pin 12 to limit the distance the pin 12 can travel in the flow portion 22 of the plunger body 16. The clutch mechanism 32 can include at least one clutch pad 36 positioned in a cut out portion 38 of the body 30 of the pin 12. The clutch mechanism 32 can also include at least one spring disposed between the clutch pad 36 and the cut-out portion to force the clutch pad 36 outward from the body 30 of the pin 12 to provide a desired clutch load. The clutch load is how much force it takes to drive the clutch pad 36 inward toward (or into) the cut-out portion 38 of the body 30 to permit the pin 12 to shift between the open and closed positions in the flow portion 22 of the plunger body 16.

The clutch pads 36 and cut out portions 38 can have any shape such that the clutch mechanism 32 performs as desired. The clutch pads 36 can also include a recessed area 40 for each spring 42 used in the clutch mechanism 32. In one exemplary embodiment, the clutch mechanism 32 can include three clutch pads 36 that extend circumferentially around the body 30 of the pin 12. Each clutch pad 36 can have numerous recessed areas 40 for multiple springs 42. In one exemplary embodiment, each clutch pad 36 can have 9 recessed areas 40 for accepting 9 springs. Springs 42 can be added or removed to generate the desired clutch load for the clutch mechanism 32. The flow portion 22 of the plunger body 16 can have a narrowed inside portion 44 that the clutch mechanism 32 has to move past as the pin 12 slides between the open position and the closed position. The narrowed portion 44 can be disposed on the inside 46 of the flow portion 22 of the plunger body 16 between the flow hole 18 and pin 12 opening. The pin 12 opening and the mandrel opening 26 can be axially directed in the plunger body 16.

The bumper portion 34 can be generated in numerous ways. In one embodiment of the present disclosure shown in FIGS. 2A-3C, the body 30 of the pin 12 can have a neck portion 48 extending therefrom in the uphole direction. A bumper sleeve 50 can slide over the neck portion 48 and be disposed therearound. The bumper sleeve 50 includes a protruded portion 52 that is wider than the body 30 of the pin 12. When the pin 12 is in the closed position the protruded portion 52 of the bumper sleeve 50 is forced against an uphole shoulder 54 in the passageway 24 between the flow hole 18 and the mandrel opening 26. The protruded portion 52 prevents the pin 12 from exiting the plunger body 16 via the pin opening 28 because the protruded portion 52 is wider than the narrowed portion 44 of the passageway 24 extending through the flow portion 22 of the plunger body 16. A seal 56 can be disposed over the neck portion 48 uphole of the bumper sleeve 50 to be forced into a sealing engagement with a portion of the passageway 24 that extends through mandrel portion 20 of the plunger body 16 when the pin 12 is in the closed position. In this embodiment, a snap ring 58 can be used to extend circumferentially around the neck portion 48 of the pin 12 uphole of the seal 56 and the bumper sleeve 50 to prevent them from sliding off the neck portion 48. The snap ring 58 can be deposited in a circumferential groove 60 disposed in the neck portion 48 to maintain the snap ring's position and thus, the position of the seal 56 and the bumper sleeve 50.

When a part of the pin 12 described in this embodiment needs to be adjusted/repaired, the pin 12 can be removed by removing the snap ring 58 from the neck portion 48 of the pin 12 via the flow hole 18 while the pin 12 is still, at least partially, disposed in the flow portion 22 of the plunger body 16. Once the snap ring 58 is removed, the seal 56 and the bumper sleeve 50 can be removed from the neck portion 48 via the flow hole 18 while the pin 12 is still, at least partially, disposed in the flow portion 22 of the plunger body 16 as well. After these parts are removed from the neck portion of the pin 12, the remaining pin 12, including the clutch mechanism 32, can be removed from the flow portion 22 of the plunger body 16 via the pin opening 28.

Figure 4A:
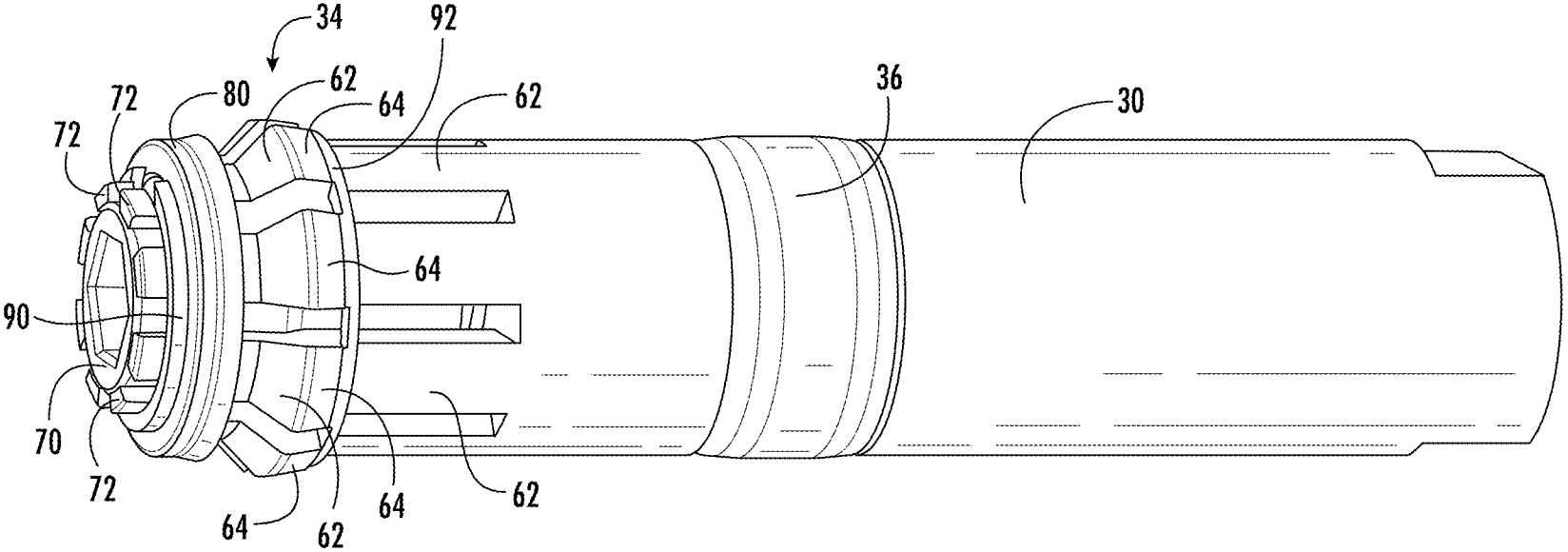
FIGS. 4A-4C show various views of another embodiment of a plunger constructed in accordance with the present disclosure.
Figure 4B:
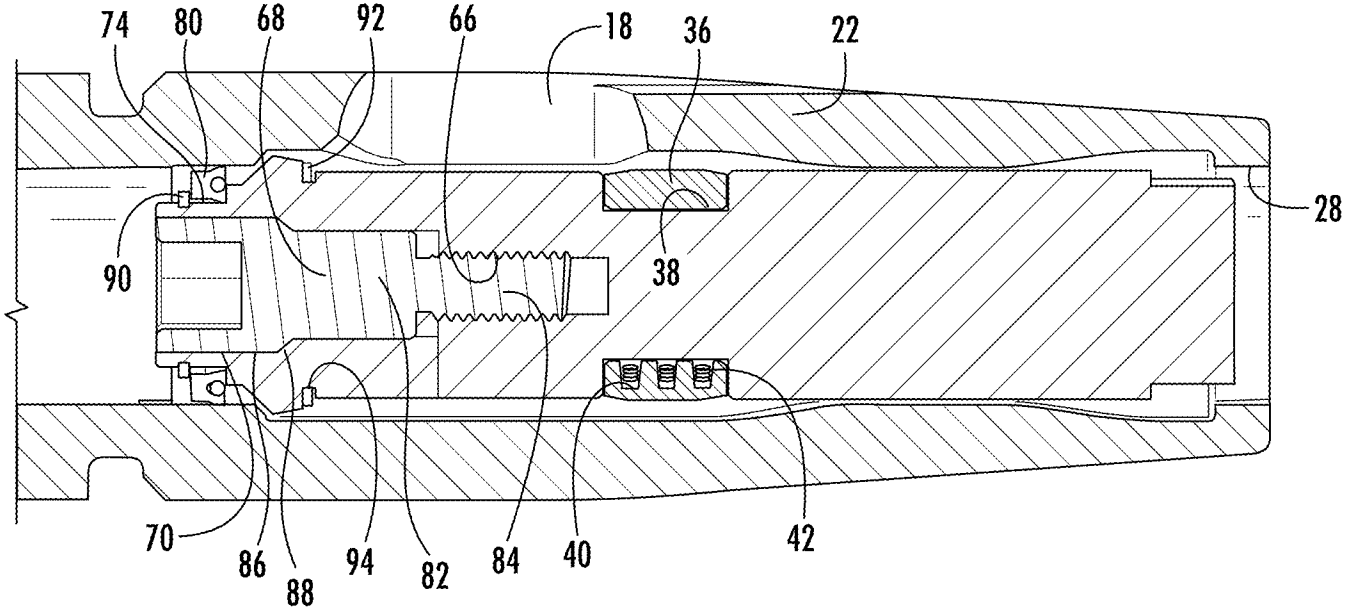
Figure 4C:
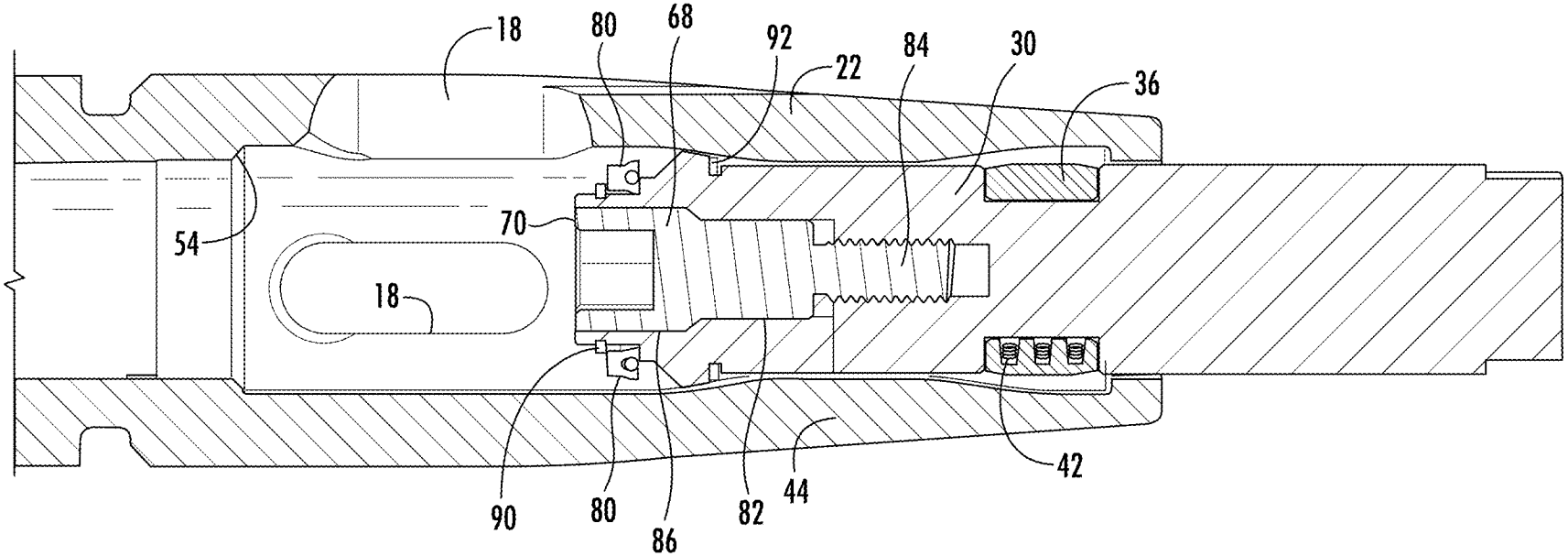

In another embodiment of the present disclosure shown in FIGS. 4A-4C, the bumper portion 34 of the pin 12 can be created via multiple fingers 62 each having a protruded portion 64 wherein the fingers extend from one end of the body 30 of the pin 12. The pin 12 can include a threaded opening 66 in the end of the body 30 of the pin 12 the fingers 62 extend from that can receive a bolt 68. The bolt 68 can have a bolt head 70 that forces the fingers 62 outward, to position the protruded portions 64 of the fingers 62 to create a bumper portion 34 that has a desired width, when the bolt 68 is threaded down into the threaded opening 66 and at least part of the bolt head 70 extends down between the fingers 62. The ends 72 of the fingers 62 can have a space 74 uphole from the protruded portions 64 that can accept a seal 80 being disposed therearound. Each finger 62 can also include a flanged end 72 that cooperates with the protruded portions 64 of the fingers 62 to keep the seal 80 in the desired axial position on the fingers 62 when the bolt 68 is threaded in the body 30 of the pin 12. When the pin 12 is in the closed position the protruded portions 64 of the fingers 62 are forced against the uphole shoulder 64 in the passageway 24 between the flow hole and the mandrel opening 26. The protruded portions 64 prevent the pin 12 from exiting the plunger body 16 via the pin opening 28 because the protruded portions 64 of the fingers 62 are wider than the narrowed portion 44 of the passageway 24 extending through the flow portion 22 of the plunger body 16.

The inside of the fingers 62 and the bolt head 70 of the bolt 68 can be shaped such that as the bolt 68 is threaded into the body 30 of the pin 12, the fingers 62 are forced/flexed outward in a radial direction. In one embodiment, the bolt head 70 has a narrow part 82 disposed adjacent to the threaded shaft 84 of the bolt 68, a wider part 86 disposed on the opposite end of the bolt 68 from the threaded shaft 84, and an angled part 88 where the bolt head 70 transitions from the narrower part 82 to the wider part 86. The inside of the fingers 62 can have a geometry that creates a mating engagement with the bolt head 70. Thus, the inside of the fingers 62 can have a narrow portion, a wider portion and an angled portion. When the bolt 68 is driven into the body 30 of the pin 12, the wider part of the bolt head is forced toward the narrow portion between the fingers 62, which causes the fingers 62 to flex outward.

In a further embodiment, a seal ring 90, or snap ring, could be disposed between the flanged ends 72 of the fingers 62 and the seal 80 to provide additional securability of the seal 80 in the desired location. In yet another embodiment, a limiter ring 92 could be disposed around the fingers 62 that is sized such that it would prevent the fingers 62 from being forced too far in a radial direction as the bolt 68 is threaded into the body 30 of the pin 12. Each finger 62 can also include a groove portion 94 that would receive the limiter ring 92 to prevent it from moving from a desired position on the pin 12.

Similar to other embodiments described herein, when a part of the pin 12 described in this embodiment needs to be adjusted/repaired, the pin 12 can be removed by removing the bolt 68 from between the fingers 62. The bolt 68 can be removed from the flow portion 22 of the plunger body 16 via the flow hole 18. Once the bolt 68 is removed, the seal ring 90 and seal 80 can be removed from the fingers 62 via the flow hole 18 as well while the pin 12 is still, at least partially, disposed in the flow portion 22 of the plunger body 16 as well. After these parts are removed from the fingers 62, the remaining pin 12, including the clutch mechanism 32, can be removed from the flow portion 22 of the plunger body 16 via the pin opening 28. Without the bolt 68, the fingers 62 can flex inward enough such that the protruded portions 64 of the fingers 62 can be pulled past the narrowed portion of the flow portion 22 of the plunger body 16. It should be understood and appreciated that, for this embodiment, the seal ring 90 and seal 80 could be removed with the pin 12 via the pin opening 28.

Figure 5A:
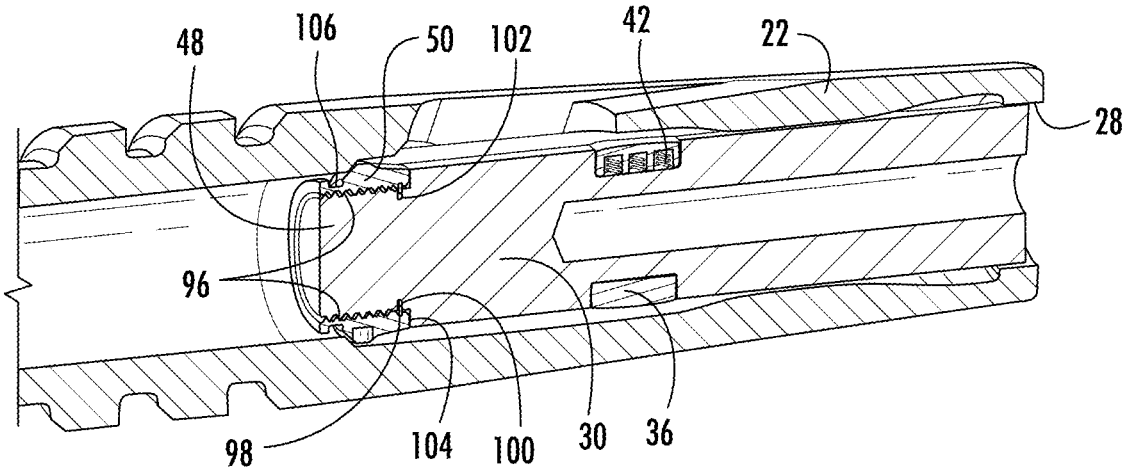
FIGS. 5A and 5B show various views of yet another embodiment of a plunger constructed in accordance with the present disclosure.
Figure 5B:
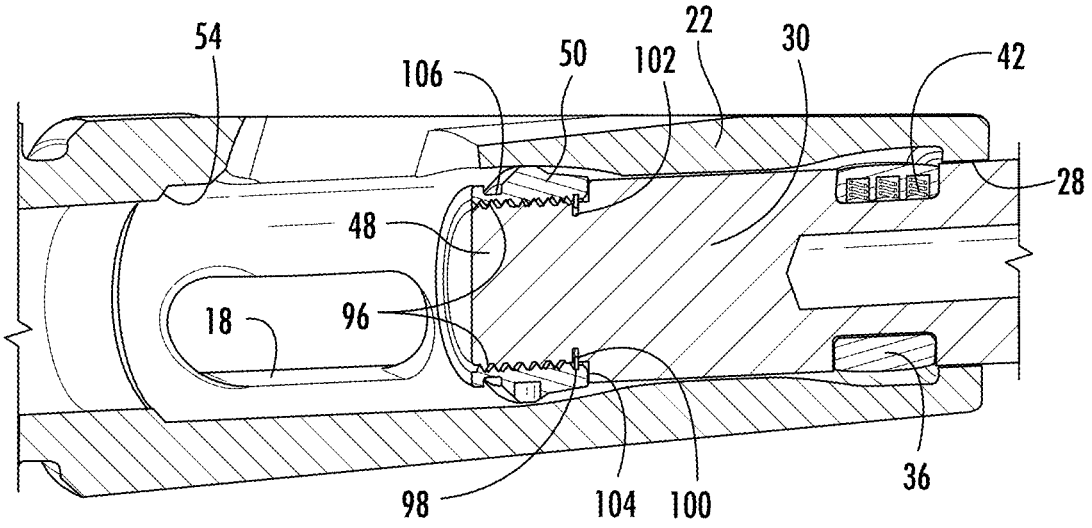

In another embodiment of the present disclosure shown in FIGS. 5A and 5B, the bumper sleeve 50 is threaded onto threads 96 disposed on the neck portion 48 of the body 30 of the pin 12. In this embodiment, the bumper sleeve 50 can have a groove 98 disposed on an inner side thereof for receiving an outer part of a snap ring 100. The neck portion 48 can also have a groove 102 disposed therein that received an inner part of the snap ring 100 when the bumper sleeve 50 is threaded onto the neck portion 48. The snap ring 100 can be disposed in the groove 98 of the neck portion 48 and then the snap ring 100 and the bumper sleeve 50 are threaded in place until the snap ring 100 reaches the groove 102 in the neck portion 48. Once this occurs, the snap ring 100 will be disposed partially in both grooves 98 and 102.

The snap ring 102 could also be threaded onto the neck portion 48 until the snap ring 100 reaches and engages the groove 102 of the neck portion 48. The bumper sleeve 50 could then be threaded onto the neck portion 48 until the groove 98 in the bumper sleeve 50 encounters and engages the snap ring 100. To facilitate the engagement of the bumper sleeve 50 with the snap ring 100 already disposed in the groove 102 of the neck portion 48, the inner side of a terminal end 104 of the bumper sleeve 50 can be angled so that terminal end 104 of the bumper sleeve 50 could be threaded past the snap ring 100 so the snap ring 100 could engage the groove 98 of the bumper sleeve 50. The bumper sleeve 50 can include a second groove 106 disposed on an outer side that can receive a sealing element (not shown) if a sealing element is desired for a particular operation.

The present disclosure is also directed to a method of removing/lifting fluids from a well using the plunger 10 described herein. The present disclosure is also directed to a method of withdrawing the pin 12, and its various parts, from the plunger body 16 to adjust and/or repair the pin 12 and/or its various components. The method also includes the step of reinstalling the pin 12 in the plunger body 16 so that the plunger 10 can function as described herein. More specifically, parts of the bumper portion 34 can be removed from the pin 12 via the flow hole 18, these parts can be repaired or adjusted and then reinstalled on the pin 12 via the flow hole 18. Once the parts of the bumper portion 34 are removed, the pin 12 is able to be removed from the plunger body 16 via the pin opening 28. The clutch mechanism 32 can also be repaired and adjusted once the pin 12 is out of the plunger body 16.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A plunger, the plunger comprising:

a single piece plunger body having a radially directed flow hole disposed therein; and a pin that shifts back and forth in the plunger body to block the flow hole in a first position and allow fluid to flow through the flow hole in a second position;

wherein the single piece plunger body is configured to retain the pin in the single piece plunger body in a downhole direction when the plunger is operational.

2. The plunger of claim 1 further comprising a clutch mechanism supported by the pin to control the force necessary to shift the pin in the plunger body.

3. The plunger of claim 2 wherein the clutch mechanism includes at least one clutch pad and at least one spring disposed between the pin and the at least one clutch pad.

4. The plunger of claim 1 further comprising a bumper portion supported by the plunger to limit the travel of the pin in the plunger body during operational use of the plunger.

5. The plunger of claim 4 wherein the bumper portion includes a bumper sleeve supported by the pin.

6. The plunger of claim 5 wherein the pin further includes a seal disposed uphole from the bumper sleeve and a snap ring disposed uphole from the seal to maintain position of the seal on the pin.

7. The plunger of claim 5 wherein the bumper sleeve is threaded onto the pin.

8. A method, the method comprising:

inserting a plunger into a well, the plunger including a single piece plunger body having a pin disposed at least partially therein, the pin shiftable back and forth in the plunger body to block a flow hole in a first position and allow fluid to flow through the flow hole in a second position;

wherein the single piece plunger body is configured to retain the pin in the single piece plunger body in a downhole direction when the plunger is operational.

9. The method of claim 8 wherein the pin has parts and at least two of the parts are assemblable via the flow hole disposed in a sidewall of the plunger body.

10. The method of claim 8 wherein the flow hole disposed in the plunger body is radially directed.

11. The method of claim 10 wherein the plunger body further comprises a clutch mechanism supported by the pin to control the force necessary to shift the pin in the plunger body.

12. The method of claim 10 further comprising a bumper portion supported by the plunger to limit the travel of the pin in the plunger body during operational use of the plunger.

13. The method of claim 12 wherein the bumper portion includes a bumper sleeve supported by the pin.

14. The method of claim 13 wherein the pin further includes a seal disposed uphole from the bumper sleeve and a snap ring disposed uphole from the seal to maintain position of the seal on the pin.

15. The method of claim 13 wherein the bumper sleeve is threadably secured to the pin.

16. The method of claim 8 further comprising assembling the pin in the single piece plunger body.

17. The method of claim 16 wherein the pin is assembled via the flow hole disposed in a sidewall of the plunger body.

18. The method of claim 17 wherein a bumper portion of the plunger is configured to be secured to the pin via the flow hole in the plunger body.

19. The method of claim 8 further comprising lifting oil and gas fluids from the well via the plunger.

* * * * *